US007658082B2

(12) United States Patent
Jagusztyn

(10) Patent No.: US 7,658,082 B2
(45) Date of Patent: Feb. 9, 2010

(54) HEAT TRANSFER SYSTEM AND ASSOCIATED METHODS

(75) Inventor: Tadeusz Frank Jagusztyn, Fort Lauderdale, FL (US)

(73) Assignee: Cotherm of America Corporation, Fort Lauderdale, FL (US)

( * ) Notice: Subject to any disclaimer, the term of this patent is extended or adjusted under 35 U.S.C. 154(b) by 449 days.

(21) Appl. No.: 11/670,132

(22) Filed: Feb. 1, 2007

(65) Prior Publication Data

US 2008/0184724 A1 Aug. 7, 2008

(51) Int. Cl.
*F25B 27/00* (2006.01)

(52) U.S. Cl. ..... 62/238.6; 62/506

(58) Field of Classification Search ..... 62/238.6, 62/506–507

See application file for complete search history.

(56) References Cited

U.S. PATENT DOCUMENTS 4,168,745 A 9/1979 Lastinger
4,211,207 A 7/1980 Molivadas
4,216,659 A 8/1980 French
4,315,402 A 2/1982 Sadhukhan
4,344,386 A 8/1982 Black
4,373,346 A * 2/1983 Hebert et al. ..... 62/79
4,481,788 A 11/1984 Yoshino
4,714,821 A 12/1987 Jakobsson
4,719,968 A 1/1988 Speros
4,787,444 A 11/1988 Countryman
4,809,523 A 3/1989 Vandenberg
4,854,378 A 8/1989 Zappia
4,892,064 A 1/1990 Zappia
4,955,207 A 9/1990 Mink
5,226,594 A 7/1993 Swenson
5,228,302 A 7/1993 Eiermann
5,305,614 A * 4/1994 Gilles ..... 62/238.7
5,339,654 A 8/1994 Cook et al.
5,493,871 A 2/1996 Eiermann
5,497,629 A 3/1996 Rafalovich et al.
5,533,362 A 7/1996 Cook et al.
5,558,273 A 9/1996 Swenson et al.

(Continued)

OTHER PUBLICATIONS

WW-330 HT Water to Water Heat Pump, E-TECH Energy Savings Solutions.

(Continued)

*Primary Examiner*—William E Tapolcai
(74) *Attorney, Agent, or Firm*—Mark R. Malek, Esq; Zies Widerman & Malek

(57) ABSTRACT

A heat transfer system includes a water line for carrying water having a first predetermined flow direction and a refrigerant line for carrying a refrigerant and having a second predetermined flow direction opposite the first predetermined flow direction. The heat transfer system includes a refrigerant evaporator, a vapor compressor, a condenser, and an expansion device. Refrigerant is passed through the refrigerant evaporator as a liquid and is warmed to a cooled gas. The refrigerant is heated to a superheated gas in the vapor compressor, and cooled to a warm liquid in the condenser. The refrigerant is cooled to a bi-phase liquid in the expansion device and is then passed to the refrigerant evaporator. Water enters the refrigerant condenser and heat is exchanged between the refrigerant and the water to warm the water to a predetermined water temperature. The water exits the refrigerant condenser and is passed to the water storage member at a predetermined temperature.

30 Claims, 6 Drawing Sheets

U.S. PATENT DOCUMENTS

| | | | | |
|---|---|---|---|---|
| 5,775,114 | A | 7/1998 | Ji | |
| 5,782,104 | A | 7/1998 | Sami et al. | |
| 5,802,864 | A | 9/1998 | Yarbrough et al. | |
| 5,901,563 | A | 5/1999 | Yarbrough et al. | |
| 6,167,715 | B1 | 1/2001 | Hebert | |
| 6,253,564 | B1 * | 7/2001 | Yarbrough et al. | 62/238.7 |
| 6,467,288 | B2 * | 10/2002 | Kuroki et al. | 62/197 |
| 6,595,011 | B1 | 7/2003 | Forgy | |
| 6,920,919 | B2 | 7/2005 | Wilson et al. | |
| 6,945,062 | B2 | 9/2005 | Chen et al. | |
| 6,978,610 | B2 | 12/2005 | Carnahan | |
| 6,988,542 | B2 | 1/2006 | Hughes et al. | |
| 7,007,453 | B2 | 3/2006 | Maisotsenko et al. | |
| 7,021,073 | B2 * | 4/2006 | Sakakibara | 62/238.7 |
| 7,024,877 | B2 | 4/2006 | Yap | |
| 7,043,934 | B2 | 5/2006 | Radermacher et al. | |
| 7,076,964 | B2 | 7/2006 | Sakakibara | |

OTHER PUBLICATIONS

WW-430 HT Water to Water Heat Pump, E-TECH Energy Savings Solutions.

WW-500 HT Water to Water Heat Pump, E-TECH Energy Savings Solutions.

WW-720 HT Water to Water Heat Pump, E-TECH Energy Savings Solutions.

* cited by examiner

HEAT TRANSFER SYSTEM AND ASSOCIATED METHODS

FIELD OF THE INVENTION

The present invention relates to the field of energy conservation, and, more particularly, to the field of heat transfer systems for warming water and related methods.

BACKGROUND OF THE INVENTION

Large structures, such as hotels, for example, may need to provide great quantities of hot water on demand to guests. This can be a problem during peak usage hours, e.g., mornings when guests are generally taking warm showers. Many hotels use hot water storage tanks to store hot water so that guests of the hotel may use hot water on demand. Water stored in hot water storage tanks are generally heated using fuel based heaters. Accordingly, energy costs may be high to maintain the hot water temperature. Further, emissions from the heaters may also cause increased pollution and global warming.

Some heat exchange systems have been introduced to enhance efficiency of a fluid heating process. For example, U.S. Pat. No. 4,892,064 to Zappia discloses a unidirectional heat transfer system that includes an enclosed and elongate narrow chamber filled with water. Caps made of a high heat conductive material are positioned on the ends of the chamber. One of the caps is a heater, and includes a thin film lining made of a fibrous material. A wick is connected to the cap and extends the length of the chamber to the opposite cap, which is described as an emitter cap. Heat is transferred from the heat cap, through the wick and into the water. This heat exchange system, however, exposes the water to a foreign element.

A hot water heater and refrigeration assembly is disclosed in U.S. Pat. No. 4,955,207 to Mink. The assembly uses the heat emitted by a refrigeration system to heat water in a hot water heater. More particularly, the assembly includes a heat pipe in the hot water tank to transfer heat provided from the refrigeration system to the hot water tank. This assembly, however, also exposes water in the hot water tank to a foreign element.

U.S. Pat. No. 5,782,104 to Sami et al. discloses an integrated air conditioning system with hot water production. The system includes a hot water tank that feeds a heat exchanger to heat air which is recirculated from a building when required to warm a building. The system also includes a dehumidifier and cooler to dehumidify and cool return air from the building in a recirculation period to cool the building. The system uses a natural gas burner as a source of heat for a hot water tank. Accordingly, the hot water is simply supplied by a gas-fired water heater system. A byproduct of such a system is emissions into the atmosphere.

U.S. Pat. No. 5,901,563 to Yarbrough et al. discloses a heat exchanger for a heat transfer system to be used to cool and dehumidify an interior space. Rejected heat may be transferred to a pool to thereby function as a pool heater. This heat exchanger, however, fails to address possible cross contamination between the refrigerant and the water.

U.S. Pat. No. 7,024,877 to Yap discloses a water heating system including a water storage vessel, a water circuit, first and second heat exchangers, and a vapor compression system. The system discloses the use of carbon dioxide as a refrigerant. Operating carbon dioxide as a refrigerant above the critical point, however, may not, as of yet, be commercially viable. Further, the water heating system does not address prevention of cross contamination between the refrigerant and the water.

SUMMARY OF THE INVENTION

In view of the foregoing background, it is therefore an object of the present invention to provide a heat transfer system suitable for heating potable water in large quantities. It is also an object of the present invention to provide a heat transfer system that prevents cross contamination between a refrigerant/refrigerant and oil mixtures and water. It is further an object of the present invention to provide a heat transfer system that may be efficiently operated and conserves energy. It is still further an object of the present invention to provide a heat transfer system that reduces emissions. It is also an object of the present invention to provide dehumidifying benefit to structures.

These, and other objects, features and advantages of the present invention are provided by a heat transfer system comprising a water line for carrying water and a refrigerant line for carrying refrigerant. The refrigerant in the refrigerant line may, for example, be a naturally occurring refrigerant. The water line has a first predetermined flow direction, and the refrigerant line has a second predetermined flow direction opposite the first predetermined flow direction. The water line is in fluid communication with a water supply.

The heat transfer system may also include a refrigerant evaporator in fluid communication with the refrigerant line, a vapor compressor in fluid communication with the refrigerant line, a condenser in fluid communication with the refrigerant line and the water line, and an expansion device in fluid communication with the refrigerant line. The heat transfer system may further include a water pump in communication with the water line to pump water from the water supply through the water line. The water pump may be a variable speed pump.

The heat transfer system may still further include a controller in communication with the vapor compressor to control capacity of the vapor compressor responsive to demand. The heat transfer system may also include a temperature sensor adjacent an outlet of the variable speed water pump and in communication with the controller. The controller is responsive to the temperature sensor to vary capacity of said vapor compressor. The controller may be remotely operable over a global communications network. This advantageously provides added control to the heat transfer system and enhances efficiency of the heat transfer system.

The refrigerant may enter the refrigerant evaporator as a liquid and may be warmed within the refrigerant evaporator to a cooled gas. The refrigerant may then enter the vapor compressor as a cooled gas and may be heated to a superheated gas. Thereafter, the refrigerant may enter the condenser as a superheated gas and may be cooled to a cooled liquid. The refrigerant may then enter the expansion device as a cooled liquid and may be cooled to a bi-phase liquid. After exiting the expansion device as a bi-phase liquid, the refrigerant may then be reintroduced to the refrigerant evaporator.

The water may enter the condenser where heat may be exchanged between the refrigerant and the water to warm the water to a predetermined water temperature. The water then exits the condenser and is passed to a water storage member at the predetermined temperature. The condenser is a double walled heat exchanger to isolate the refrigerant from the water. This advantageously enhances the prevention of cross contamination so that the heat transfer system may be used to warm potable water.

The condenser may include a refrigerant de-superheater in fluid communication with the refrigerant line and the water line, a refrigerant condenser in fluid communication with the water line and the refrigerant line, and a refrigerant sub-cooler in fluid communication with the water line and the refrigerant line. Accordingly, the refrigerant may enter the refrigerant de-superheater, and may be cooled to a hot gas, and further cooled to a warmed liquid in the refrigerant condenser. The refrigerant may then be cooled to a cooled liquid in the refrigerant sub-cooler, and to a bi-phase liquid in the expansion device.

Each of the refrigerant evaporator, vapor compressor, refrigerant de-superheater, refrigerant condenser, refrigerant sub-cooler, and expansion device may comprise a refrigerant inlet and a refrigerant outlet. Further, each of the refrigerant sub-cooler, refrigerant condenser and refrigerant de-superheater may comprise a water inlet and a water outlet.

The heat transfer system may also comprise a second water line in communication with the refrigerant evaporator and an air conditioning return water line. The second water line may pass warmed water from the air conditioning return water line through the refrigerant evaporator to warm the refrigerant in the refrigerant evaporator. Thereafter, the water may be passed back into the air conditioning return water line where it is passed to the air conditioning chiller for further use in the air conditioning system.

The water supply may comprise a first and a second water supply. The first water supply may be a water storage member, and the second water supply may be a municipal water supply. The water from the water storage member may be mixed with water from the municipal water supply after the water from the municipal water supply is passed through the refrigerant sub-cooler and before the water is passed through the refrigerant condenser. Further, the water from the water storage member is taken from the water storage member adjacent a bottom of the water storage member.

The heat transfer system may also comprise a housing to carry each of the refrigerant evaporator, the vapor compressor, the refrigerant condenser and the expansion device. The housing advantageously allows the heat transfer system to be transported as a single unit. Accordingly, the housing advantageously decreases transportation and shipping costs associated with delivering the heat transfer system to its final destination. The housing preferably includes a power source connector to be connected to a power source. Accordingly, the heat transfer system of the present invention may advantageously be self contained within the housing.

The refrigerant may enter the refrigerant evaporator at a temperature between about 35 degrees Fahrenheit and 55 degrees Fahrenheit, and may exit the refrigerant evaporator at a temperature between about 35 degrees Fahrenheit and 55 degrees Fahrenheit. The refrigerant may exit the vapor compressor at a temperature between about 150 degrees Fahrenheit and 185 degrees Fahrenheit, and may exit the refrigerant de-superheater at a temperature between about 130 degrees Fahrenheit and 145 degrees Fahrenheit. The refrigerant may exit the refrigerant condenser at a temperature between about 115 degrees Fahrenheit and 145 degrees Fahrenheit, the refrigerant sub-cooler at a temperature between about 85 degrees Fahrenheit and 95 degrees Fahrenheit and the expansion device at a temperature between about 35 degrees Fahrenheit and 55 degrees Fahrenheit.

The water may enter the refrigerant sub-cooler from the municipal water supply at a temperature between about 65 degrees Fahrenheit and 85 degrees Fahrenheit. The water may exit the refrigerant sub-cooler at the first predetermined water temperature between about 95 degrees Fahrenheit and 110 degrees Fahrenheit. The water may then be taken from the bottom of the water storage member at a temperature of between about 125 degrees Fahrenheit and 135 degrees Fahrenheit. The water exiting the refrigerant sub-cooler may be mixed with the water exiting the storage tank to define mixed water.

The mixed water may have a second predetermined water temperature between about 115 degrees Fahrenheit and 125 degrees Fahrenheit. The water enters the refrigerant condenser at the second predetermined water temperature and is warmed to the third predetermined water temperature between about 130 degrees Fahrenheit and 135 degrees Fahrenheit. The water thereafter enters the refrigerant de-superheater at the third predetermined water temperature and exits the refrigerant de-superheater at the fourth predetermined water temperature between about 135 degrees Fahrenheit and 140 degrees Fahrenheit. The water line may carry potable water. Accordingly, in the areas of the heat transfer system where refrigerant and water are adjacent one another to transfer heat therebetween, the heat transfer system of the present invention advantageously takes precautions, i.e., double walled heat exchangers, to shield from cross-contamination between the potable water and the refrigerant, thereby allowing for the warming of potable water for domestic use.

A method aspect of the present invention is for warming water for a water supply. The method may include pumping a refrigerant through a refrigerant line. The refrigerant passes through a refrigerant evaporator to warm the refrigerant to a cooled gas, a vapor compressor to heat the cooled gas to a superheated gas, a condenser to cool the superheated gas to a warmed liquid, an expansion device to cool the warmed liquid to a bi-phase liquid, and back to the refrigerant evaporator.

The method may also include pumping water using a variable speed water pump through a water line adjacent the refrigerant line to absorb heat from the refrigerant. The water passes through the refrigerant condenser to be warmed to a predetermined water temperature, and exits the refrigerant condenser to a water storage member. The method may further include operating a controller in communication with the vapor compressor to control capacity of the vapor compressor responsive to a temperature sensor adjacent an outlet of the variable speed water pump and in communication with the controller.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
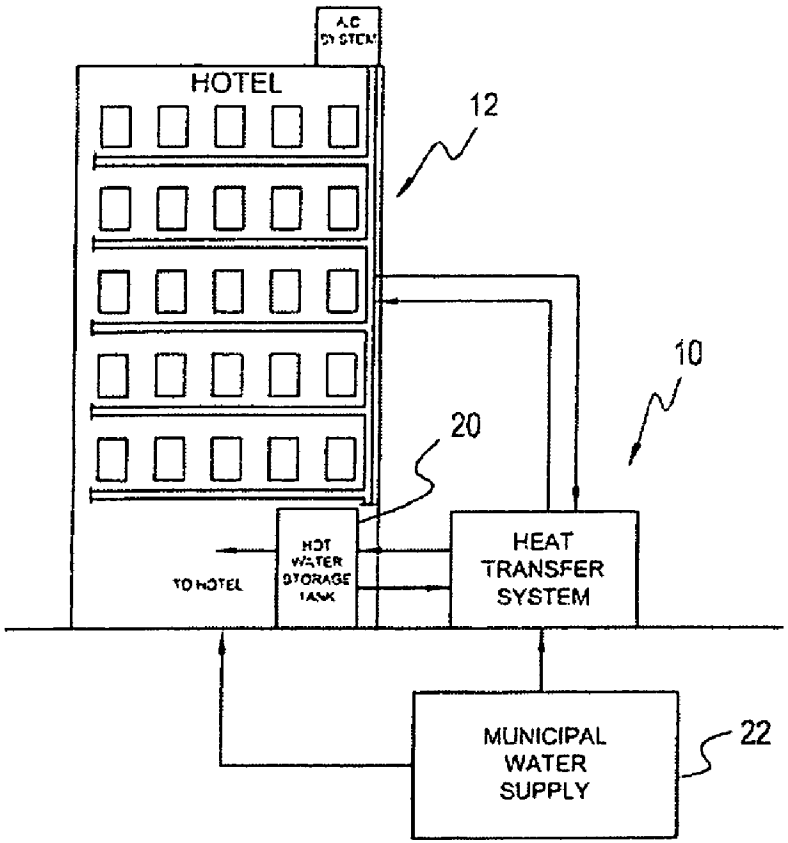
FIG. 1 is a schematic view of heat transfer system according to the present invention in communication with a structure.

Referring initially to FIG. 1, a heat transfer system 10 according to the present invention is preferably positioned in communication with a structure 12 to warm water to be used within the structure. For example, the structure 12 may be a hotel, a hospital, or any other type of structure housing several people in need of warm, potable water. Hotels and hospitals, in particular, generally require hot water on demand in great quantities for the purpose of human hygiene and humidity control, i.e., reheat. Accordingly, the heat transfer system 10 of the present invention advantageously provides water suitable for domestic use within the structure 12.

Figure 2:
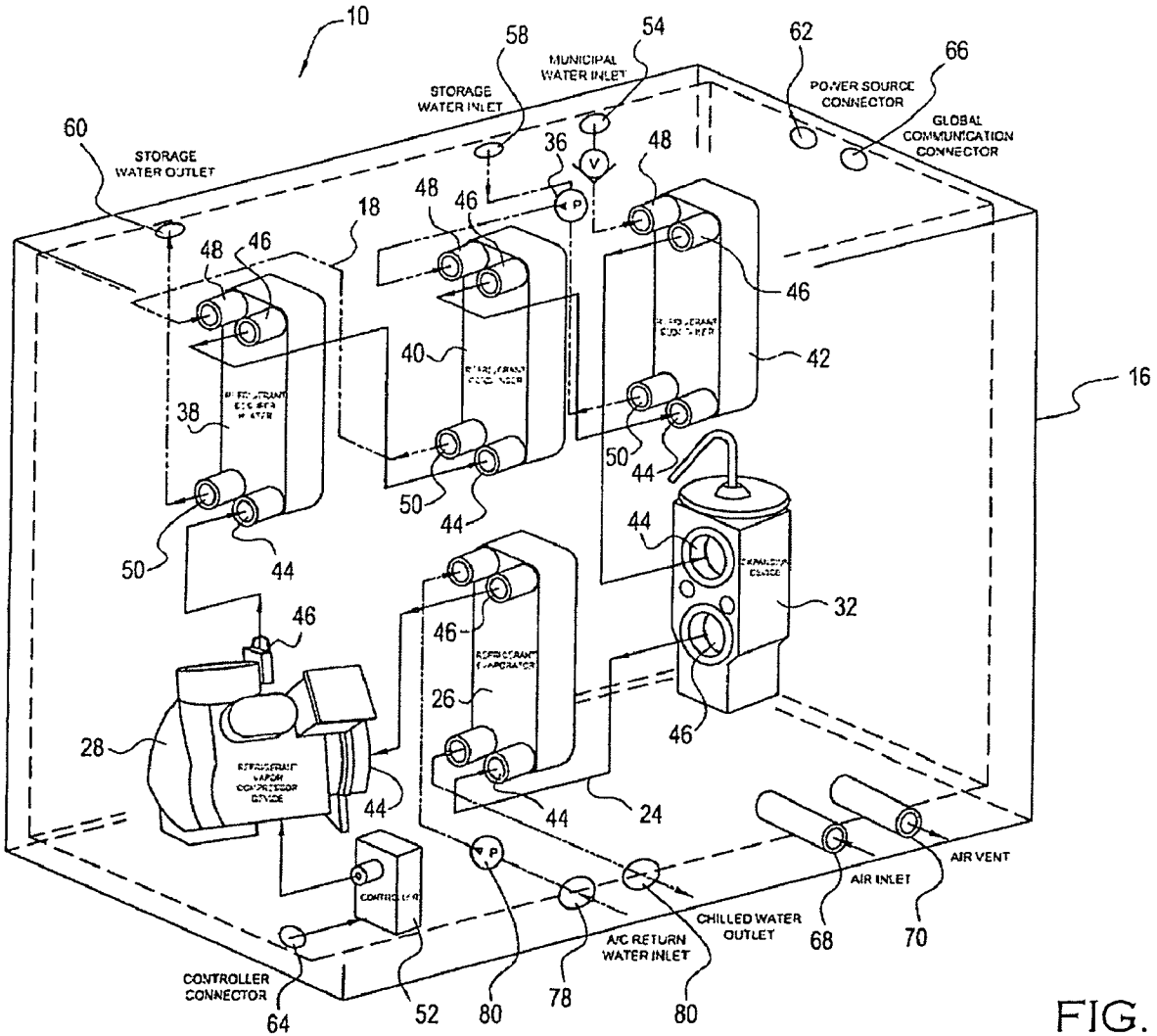
FIG. 2 is a schematic view of components of the heat transfer system in a container according to the present invention.
Figure 3:
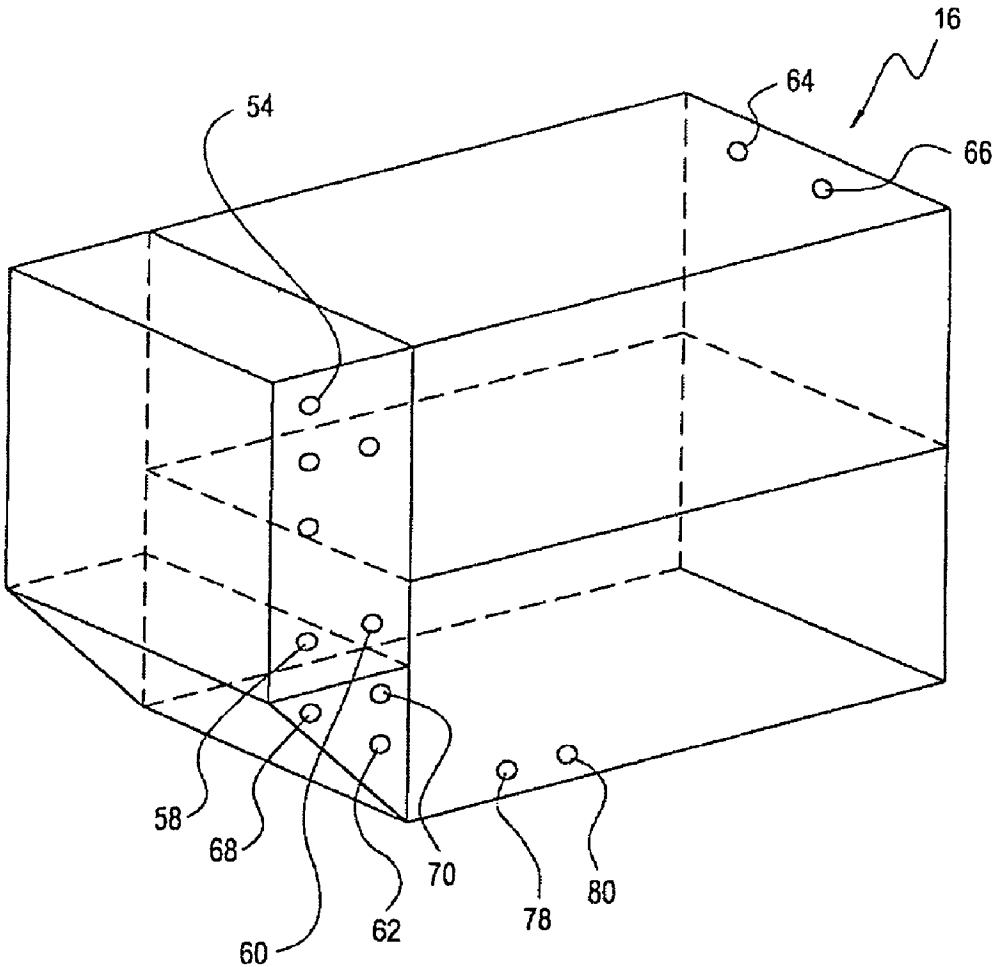
FIG. 3 is a schematic view of the container of the heat transfer system illustrated in FIG. 2.

Referring now additionally to FIGS. 2-3, additional aspects of the heat transfer system 10 are now described in greater detail. The heat transfer system 10 illustratively comprises a housing 16. The housing 16 carries the components of the heat transfer system 10. The components of the heat transfer system 10 will be discussed in greater detail below. The housing 16 is preferably an air cargo container, e.g., ULD3, but those skilled in the art will appreciate that any other housing suitable for containing the components of the heat transfer system 10 is also contemplated by the present invention. For example, the housing may also be a rail car, a shipping container, e.g., a 20 or a 40 foot shipping container, a crate, or any other type of housing. The housing 16 illustratively includes a plurality of connection members that will be described in greater detail below.

Figure 4:
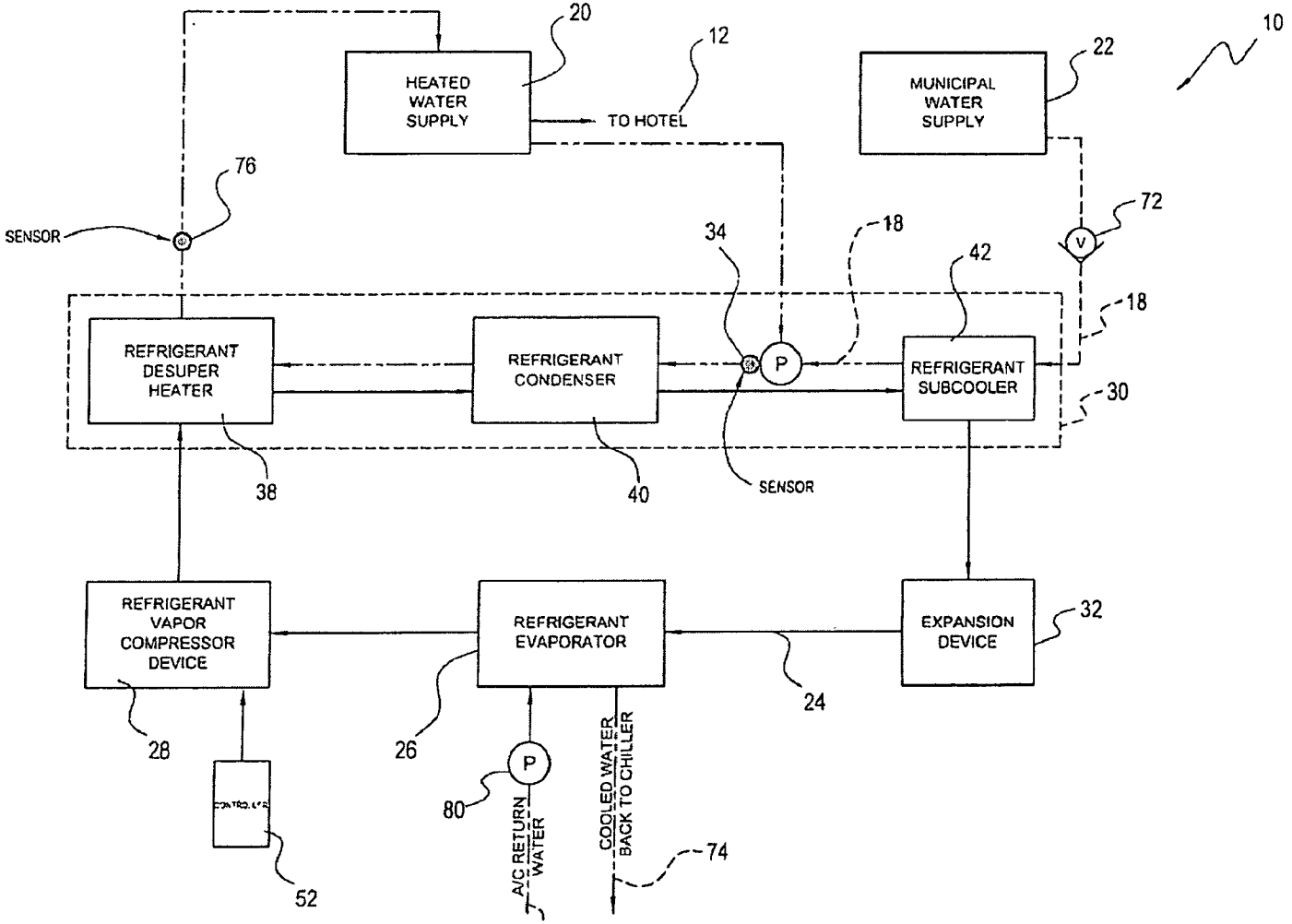
FIG. 4 is an exploded schematic view of the heat transfer system according to the present invention.

Referring now additionally to FIG. 4, the components of the heat transfer system 10 are now described in greater detail. The heat transfer system 10 illustratively includes a water line 18 for carrying water therein. The water line 18 preferably has a first predetermined flow direction illustrated, for example, by the arrow in FIG. 4. The water line 18 is in fluid communication with a water supply. More particularly, the water supply may include a first water supply 20 and a second water supply 22. The first water supply 20 may, for example, be a water storage member. The water storage member 20 is preferably a hot water storage tank located within or adjacent the structure 12. The hot water storage tank is preferably maintained at a predetermined temperature of between about 130 degrees Fahrenheit and 140 degrees Fahrenheit. Maintaining the water within the hot water tank 20 as the predetermined temperature advantageously reduces the possibility of bacteria growth, such as Legionella, for example, which may be found in some man made water systems and which, when humans are exposed to such bacteria, may cause diseases, such as pneumonia, for example.

The second water supply 22 may, for example, be a municipal water supply. In other words, the second water supply 22 may be the water supply normally running into the structure 12. The municipal water supply 22 generally runs throughout the entire structure 12. Those skilled in the art will appreciate that the water line 18 of the heat transfer system 10 may be tapped into the municipal water supply 22 at any location.

The heat transfer system 10 also includes a refrigerant line 24 for carrying a refrigerant. The refrigerant line 24 preferably has a second predetermined flow direction illustrated, for example, by the arrows in FIG. 4. The second predetermined flow direction is opposite from the first predetermined flow direction.

The heat transfer system 10 also includes a refrigerant evaporator 26 in fluid communication with the refrigerant line 24, a vapor compressor 28 in fluid communication with the refrigerant line 24, and a condenser 30 in fluid communication with the refrigerant line. The condenser 30 comprises a refrigerant de-superheater 38 in fluid communication with the refrigerant line 24 and the water line 18, a refrigerant condenser 40 in fluid communication with the water line and, more specifically, with the municipal water supply 22, and with the refrigerant line, and a refrigerant sub-cooler 42 in fluid communication with the water line and the refrigerant line. The heat transfer system 10 further includes an expansion device 32 in fluid communication with the refrigerant line 24.

The refrigerant preferably enters the refrigerant evaporator 26 as a liquid and is warmed within the refrigerant evaporator to a cooled gas. More particularly, the refrigerant preferably enters the refrigerant evaporator at a temperature between about 35 degrees Fahrenheit and 55 degrees Fahrenheit and is warmed to a temperature between about 35 degrees Fahrenheit and 55 degrees Fahrenheit upon its exit from the refrigerant evaporator. Thereafter, the refrigerant enters the vapor compressor 28 as a cooled gas and is warmed to a superheated gas. More particularly, the refrigerant preferably exits the vapor compressor at a temperature between about 150 degrees Fahrenheit and 185 degrees Fahrenheit. The vapor compressor 28 preferably pressurizes the refrigerant, thereby increasing the temperature of the refrigerant. The vapor compressor 28 includes a compressor that may, for example, be driven by a piston-driven compressor, a rotary-driven compressor, or any other type of compressor, as understood by those skilled in the art. The compressor may be driven by an electrical motor, but the present invention also contemplates the use of any other type of motor to drive the compressor. More specifically, the compressor propels the refrigerant through the refrigerant line 24.

The refrigerant then enters the refrigerant de-superheater 38 as a superheated gas, i.e., a gas having a temperature between about 150 degrees Fahrenheit and 185 degrees Fahrenheit, and is cooled to a hot gas. In other words, the gas refrigerant is no longer superheated. The refrigerant exiting the refrigerant de-superheater preferably has a temperature between about 130 degrees Fahrenheit and 145 degrees Fahrenheit. Thereafter, the refrigerant is directed into the refrigerant condenser 40 as a cooled gas and is cooled, i.e., condensed, to a warmed liquid. The preferred temperature of the refrigerant as it exits the refrigerant condenser 40 is between about 115 degrees Fahrenheit and 125 degrees Fahrenheit.

The refrigerant is then passed to the refrigerant sub-cooler 42 where it is cooled to a cooled liquid. The temperature of the refrigerant upon exit from the refrigerant sub-cooler 42 is preferably between about 85 degrees Fahrenheit and 95 degrees Fahrenheit. Thereafter, the refrigerant enters the expansion device 32 as a cooled liquid and is cooled to a bi-phase liquid. The expansion device 32 may, for example, be provided by an expansion valve. Further, the expansion device 32 may include an orifice through which the refrigerant must pass. This may cause the refrigerant to partially transform into flash gas. Accordingly, the refrigerant is cooled to a state of liquid and gas. More particularly, the bi-phase liquid may best be described as a bubbling liquid. The preferred temperature of the refrigerant upon exit from the expansion device 32 is between about 35 degrees Fahrenheit and 55 degrees Fahrenheit. The refrigerant is thereafter passed to the refrigerant evaporator 26.

The flow of water through the water line 18 of the heat transfer system 10 is now described in greater detail. More particularly, water enters the refrigerant sub-cooler 42 and is warmed to a first predetermined water temperature. The water preferably enters the refrigerant sub-cooler 42 from the municipal water supply 22 at a temperature between about 65 degrees Fahrenheit and 80 degrees Fahrenheit. As will be discussed in greater detail below, before entering the refrigerant sub-cooler 42, the water passes through a metered valve 72. Thereafter, the water is warmed within the refrigerant sub-cooler 42 to the first predetermined water temperature which is between about 95 degrees Fahrenheit and 110 degrees Fahrenheit. The water then enters the refrigerant condenser 40 at the first predetermined water temperature, and is warmed to a second predetermined water temperature.

The water exiting the refrigerant sub-cooler 42 at the first predetermined water temperature is preferably mixed with warm water from the water storage member 20. The water taken from the water storage member 20 is preferably taken from the bottom thereof, and preferably has a temperature between about 125 degrees Fahrenheit and 135 degrees Fahrenheit. The mixed water temperature defines the second predetermined temperature of the water, which is preferably between about 115 degrees Fahrenheit and 125 degrees Fahrenheit. Thereafter, the mixed water enters the refrigerant condenser 40 at the second predetermined water temperature and is warmed to a third predetermined water temperature, which is preferably between about 130 degrees Fahrenheit and 135 degrees Fahrenheit. The water then enters the refrigerant de-superheater 38 at the third predetermined water temperature and is warmed to a fourth predetermined water temperature, which is preferably between about 135 degrees Fahrenheit and 145 degrees Fahrenheit. The water having the fourth predetermined water temperature is then re-introduced into the water storage member 20 for use as domestic water within the structure 12.

Each of the refrigerant evaporator 26, vapor compressor 28, refrigerant de-superheater 38, refrigerant condenser 40, refrigerant sub-cooler 42, and expansion device 32 comprises a refrigerant inlet 44 and a refrigerant outlet 46. Each of the refrigerant sub-cooler 42, refrigerant condenser 40, and refrigerant de-superheater 38 comprises a refrigerant inlet 44, a refrigerant outlet 46, a water inlet 48, and a water outlet 50.

The vapor compressor 28 includes a compressor to propel the refrigerant through the refrigerant line 24. More specifically, and as discussed above, the vapor compressor 28 may be a piston driven compressor. Those skilled in the art will appreciate that the piston driven compressor includes a plurality of cylinders. Further, the vapor compressor 28 may operate at different capacities, depending on hot water demand. Therefore, in order to operate at different capacities, cylinders of the piston driven compressor may be turned on and off, again, depending on demand. The vapor compressor 28 may also be provided by rotary driven compressor. Those skilled in the art will appreciate that capacity of the vapor compressor may be adjusted in a rotary driven compressor by simply changing the speed of a rotary screw in the rotary driven compressor depending on demand.

The heat transfer system 10 further includes a water pump 36 is in communication with the water line 18 to pump water from the water supply through the water line. More particularly, water from the water storage member 20 is preferably mixed with water from the municipal water supply 22 before being pumped through the water line 18 by the water pump 36. The water pump 36 may be a constant speed water pump or a variable speed water pump, as understood by those having skill in the art. Further, the valve 72 regulates the amount of municipal water entering the system from the municipal water supply 22 to ensure that a proper amount of water is entering depending on demand of the users accessing the water storage member 20.

As discussed above, the water from the water storage member 14 is preferably mixed with water from the municipal water supply 22 after the water from the municipal water supply is passed through the refrigerant sub-cooler 42 and before the water is passed through the refrigerant condenser 40. The water from the water storage member 20 is taken from the water storage member adjacent a bottom of the water storage member. Warm water entering the water storage member 20 is generally introduced into the water storage member adjacent a top of the water storage member.

As also discussed above, the heat transfer system 10 includes a water pump 36. The water pump 36 is positioned to pump water from the water storage member 20 and from the water outlet 50 of the refrigerant sub-cooler 42 through the water line 18. The water pump 36 is preferably powered by a electric motor. Those skilled in the art, however, will appreciate that the water pump 36 may also be powered by any other similar type of motor. The water pump 36 may be a variable speed water pump to advantageously allow for increased and decreased water flow through the water line 18.

Figure 5:
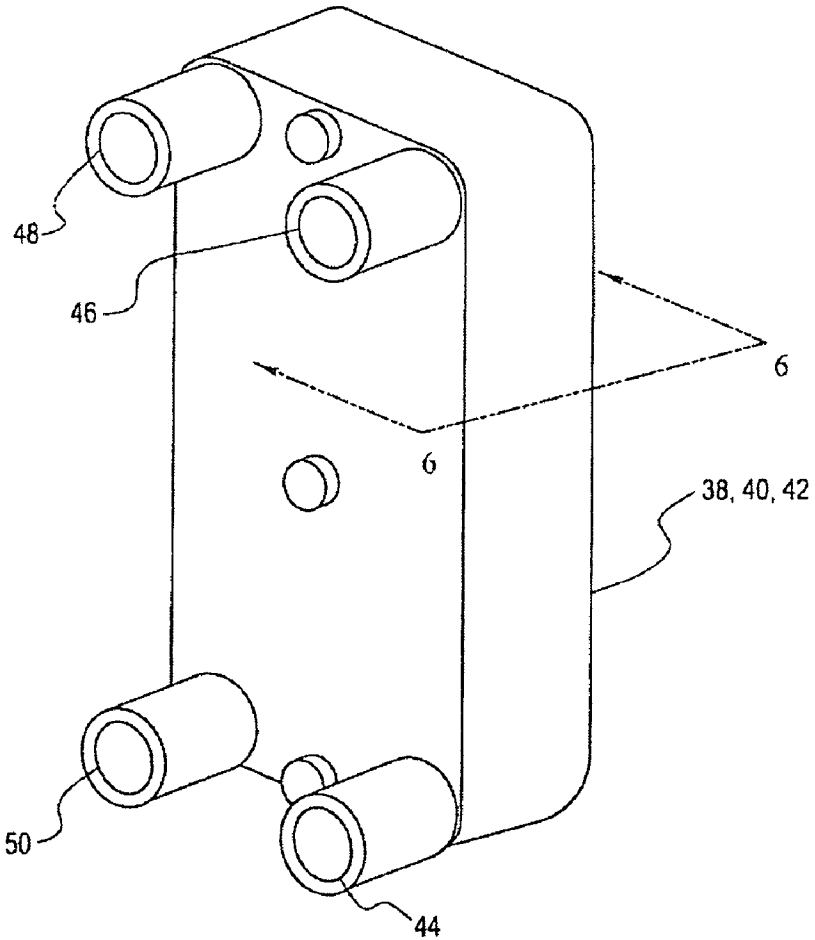
FIG. 5 is a perspective view of a heat exchanger of the heat transfer system according to the present invention and including refrigerant and water inlets and outlets.
Figure 6:
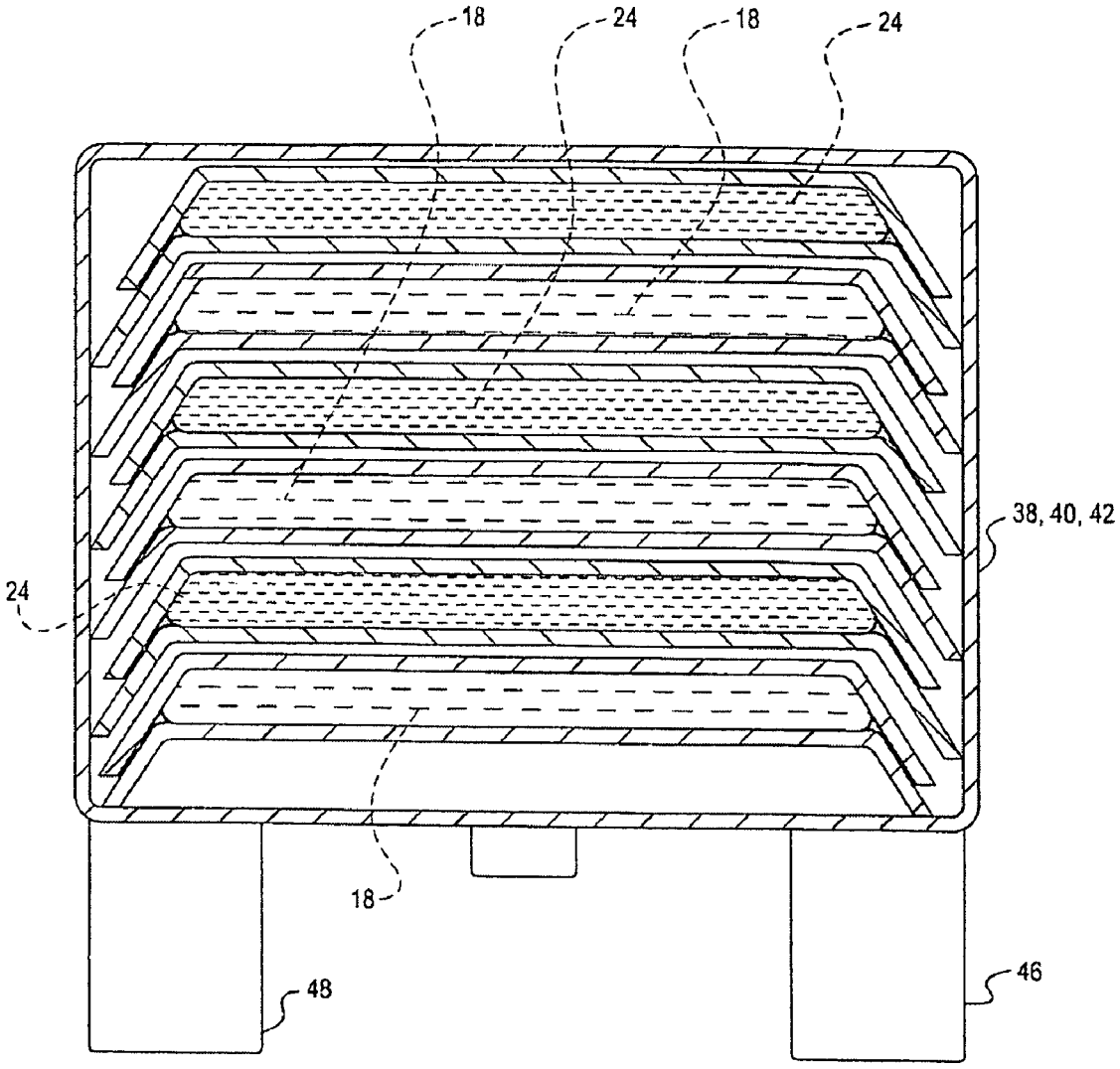
FIG. 6 is a cross sectional view of the heat exchanger illustrated in FIG. 5 taken through line 6-6.

The heat transfer system 10 of the present invention advantageously takes precautions to isolate the refrigerant in the refrigerant line 24 from the water in the water line 18. This advantageously allows the water in the water line 18 to be potable water without cross contamination from the refrigerant or refrigerant and oil mixture. More specifically, and as illustrated in FIGS. 5 and 7, the refrigerant sub-cooler 42, the refrigerant condenser 40, and the refrigerant de-superheater 38 are double walled to isolate the water from the refrigerant. More particularly, each of the refrigerant sub-cooler 42, the refrigerant condenser 40, and the refrigerant de-superheater 38 may be provided by double walled heat exchangers. These types of heat exchangers are illustrated, for example, in FIG. 5, i.e., heat exchangers having a refrigerant inlet 44, a refrigerant outlet 46, a water inlet 48 and a water outlet 50. The double walled heat exchangers are preferable double walled plate heat exchangers, but those skilled in the art will appreciate that any other type of double walled heat exchanger may be provided to achieve the objects, goals and advantages of the present invention.

Those skilled in the art will appreciate that a typical heat exchanger provides a plurality of channels through which a warm fluid travels, and an adjacent plurality of channels through which a cool fluid travels. Accordingly, heat may be transferred between the warm and cool fluids as they travel in opposite directions through the channels of the heat exchanger. In the heat transfer system 10 of the present invention, and as is similar in other heat transfer systems, the refrigerant passes through the refrigerant line 24 along with oil. The oil is used to lubricate the components of the heat transfer system 10. Accordingly, if using a typical heat exchanger, i.e., a heat exchanger wherein one fluid travels adjacent another fluid, there is an inherent risk of cross contamination. In other words, there is a risk that a breach may occur in one of the channels, thereby allowing oil and refrigerant to contaminate the water. Therefore, water in such systems are not suitable to be used as potable water.

The double walled plate heat exchangers provided for the refrigerant sub-cooler 42, the refrigerant condenser 40, and the refrigerant de-superheater 38 advantageously provide a space between each channel through which the water and refrigerant/oil mixture travels to prevent cross-contamination between the refrigerant/oil mixture and the water. Accordingly, in the case of any breach in a channel carrying one of the fluids, the fluid that is leaking out of the channel will be contained within the space, and will not cross contaminate the other fluid being passed through the heat exchanger. Those skilled in the art will appreciate, however, that where cross contamination is not a concern, the heat exchangers may be single walled.

The present invention contemplates the use of sensors within the space to sense the intrusion of any foreign substance into the space between the channels. The present invention also contemplates that heat exchange technology will likely advance to the point wherein the refrigerant does not have to be mixed with oil for lubrication purposes. In such a case, it may be possible, although likely not desirable, to use a traditional heat exchanger. Those skilled in the art, however, will appreciate that in cases where a hydrocarbon refrigerant is used, such as propane, for example, a double walled heat exchanger should be used to prevent cross contamination between the refrigerant and the water.

The heat transfer system 10 of the present invention also comprises a controller 52 in communication with the vapor compressor 28 to control capacity of the vapor compressor responsive to demand. The controller 52 may be remotely operable over a global communications network to control water flow through the water line 18 responsive to water demand. In other words, the controller 52 may be operated remotely via the Internet. Accordingly, the vapor compressor 28 may be controlled to increase or decrease capacity responsive to the controller. The controller 52 may also be used to remotely monitor the heat transfer system 10 and to provide off site maintenance to the heat transfer system, e.g., monitoring and service may advantageously be accomplished over the global communications network. The remote monitoring feature of the present invention advantageously provides an indication to an operator when preventative maintenance may be necessary, and when other maintenance may be necessary. Accordingly, any down time of the heat transfer system 10 of the present invention is advantageously minimized.

A water temperature sensor 34 may be provided adjacent an outlet of the water pump 34 and in communication with the controller for sensing the water temperature of the water being pumped into the refrigerant condenser 40. The sensed water temperature provides an indication of the necessary capacity of the vapor compressor 28. In other words, the sensed water temperature provides an indication to the controller 52 of the hot water demand. Upon sensing a water temperature below a predetermined water temperature, the controller 52 may initiate increased capacity of the vapor compressor 28. Similarly, upon sensing a water temperature above a predetermined water temperature, the controller 52 may initiate decreased capacity of the vapor compressor 28, i.e., turn off some cylinders of a piston driven vapor compressor, or decrease the speed of the screw in a rotary driven vapor compressor.

An additional water temperature sensor 76 may be positioned adjacent the water outlet 50 of the refrigerant de-superheater 38. More specifically, the water temperature sensor 76 advantageously monitors the temperature of water being discharged from the refrigerant de-superheater 38 into the water storage member 20. The water temperature sensor 76 may be in communication with the controller 52 so that capacity of the vapor compressor 28 may be controlled responsive to the sensed water temperature. Accordingly, the heat transfer system 10 of the present invention may advantageously control capacity of the vapor compressor 28 responsive to any one of a number of factors, including water temperatures monitored throughout the system.

A valve 72 may be positioned adjacent the area where the municipal water supply is tapped to monitor and regulate the amount of water being introduced into the heat transfer system 10. The valve 72 is preferably in communication with the controller 52 so that the controller may also change capacity of the vapor compressor 28 responsive to the amount of water being introduced into the heat transfer system 10. The valve 72 may, for example, be a check valve, or any other type of valve, as understood by those skilled in the art. Those skilled in the art will appreciate that the second water supply 22 may also be provided by a well.

A second water line 74 may also be provided in communication with the refrigerant evaporator 26. The water source of the second water line 74 is preferably the air conditioning return water. Chilled water air conditioning systems use chilled water to cool the structure 12. The chilled water becomes warmed after it passes through the structure 12 and is returned to a chiller in the air conditioning system to be re-cooled.

The heat transfer system 10 of the present invention contemplates tapping the air conditioning return water line, extracting warm water from the air conditioning return line, and using the warmed water in the second water line 74 to heat the refrigerant passing through the refrigerant evaporator 26. The air conditioning return water is heated from passing through the structure 12. Various factors heat the air conditioning return water such as, for example, sun, lights in the structure 12, and internal heat producing devices. The heat that is extracted from the warm water in the refrigerant evaporator 26 provides most of the heat necessary to heat the refrigerant to the temperature between about 35 degrees Fahrenheit and 55 degrees Fahrenheit. A sensor (not shown) may be provided adjacent the second water line 74 and be positioned in communication with the vapor compressor 28. This sensor may be used to sense water temperature coming into and leaving the refrigerant evaporator 28 so that the controller 52 may adjust capacity depending upon the amount of heat available to heat the refrigerant in the evaporator. An air conditioning return water pump 80 may also be included to pump the air conditioning return water through the evaporator.

Although it is preferable that the refrigerant evaporator 26 be provided by a double walled plate heat exchanger, those skilled in the art will appreciate that since the air conditioning return water is not used as potable water, a traditional heat exchanger may be used. After the air conditioning return water has been cooled in the refrigerant evaporator 26, i.e., after heat has been extracted from the water to warm the refrigerant, it is returned to the air conditioning chiller to undergo further cooling. This water in the air conditioning return line, however, has already undergone cooling in the refrigerant evaporator 26 prior to returning to the air conditioning chiller and accordingly, requires less cooling before being used to cool the rooms. Therefore, the present invention advantageously also enhances energy savings associated with cooling costs.

Another benefit of using the air conditioning return water to heat the refrigerant in the refrigerant evaporator 26 is a dehumidifying benefit. In other words, the heat being extracted from the air conditioning return water is used to heat water in the water storage member 20. The use of the air conditioning return water to heat the refrigerant in the refrigerant evaporator 26 advantageously decreases humidity within the structure 12, thereby decreasing the need for air conditioning within the structure, while simultaneously enhancing comfort, as well as energy savings. Those skilled in the art will appreciate that reheat after dehumidification is an effective method of controlling humidity within the structure 12. The method is often used in hospitals but not applied in hotels due to the high cost of heating the air after dehumidification. The hot water in water storage member 20 can be advantageously used to decrease and control the humidity within the structure 12. It is well known that maintaining indoor humidity below 60% RH is a key strategy for maintaining good indoor air quality and preventing sick building syndrome. Therefore the invention enables enhanced comfort and IAQ while simultaneously saving energy The refrigerant in the refrigerant line 24 is preferably a naturally occurring refrigerant. For example, the refrigerant is preferably provided by carbon dioxide, propane, isobutene, or ammonia. Those skilled in the art, however, will appreciate that the refrigerant may also be provided by commonly used refrigerants, such as R134A, RR410A and R22.

Referring now back to FIG. 3, additional details of the housing 16 of the heat transfer system 10 are now described. More specifically, and as mentioned above, the housing 16 includes a plurality of connection members. The connection members may, for example, include a municipal water inlet connector 54. The municipal water inlet connector is preferably a tap to be connected to the municipal water supply 22 running through the structure 12.

The connectors may also include a water storage member inlet connector 58 and a water storage member outlet connector 60. The water storage member inlet connector preferably connects the heat transfer system 10 to the water storage member 20 so that water may be pulled from the water storage member adjacent a bottom of the water storage member. The water storage member outlet connector 60 preferably emits hot water from the heat transfer system to a top of the water storage member 20.

The connectors also include a power source connector 62. The power source connector is used to connect the heat transfer system 10 to an adjacent power source within the structure 12. Those skilled in the art will appreciate that the power source connector 62 may be used to connect to the power running through the structure 12, or may be used to connect to an external power source not associated with the structure.

The connectors may still further include a controller connector 64 and a global communications network connector 66. More specifically, the controller connector 64 may be used to connect the controller 52 of the heat transfer system 10 to a user interface. For example, the user interface may be a computer located on-site at the structure 12. The global communications network connector 66 advantageously allows the controller 52 of the heat transfer system 10 to be connected to a global communications network so that the heat transfer system may be remotely operated and monitored. The connectors may also include an air conditioning return water inlet connector 78 and a chilled water outlet 80 so that the return air conditioning water may be routed into the refrigeration evaporator 26 to be used to warm the refrigerant running therethrough.

The heat transfer system 10 preferably includes a refrigerant scavenger system to control refrigerant released into the housing 16. Although refrigerant release into the housing 16 is unlikely, it is advantageous to have a system to monitor such a release, and evacuate the refrigerant released within the housing. Accordingly, the housing 16 may include a refrigerant sensor (not shown) an air inlet 68, and a refrigerant vent. 70 to allow refrigerant to be vented from the housing 16. More particularly, the sensor may sense refrigerant concentration within the housing 16 and may vent the refrigerant form the housing or, if necessary, allow air into the housing through the air inlet 68. The air inlet 68 may, for example, introduce filtered air into the housing 16.

Those skilled in the art will appreciate that a plurality of heat transfer systems 10 may be provided at a particular structure 12. More particularly, the heat transfer systems 10 may be circuits, each with independent refrigerant lines 24 and water lines 18. This advantageously allows for the heat transfer system 10 of the present invention to meet capacity requirements of a particular structure 12. The use of a plurality of circuits of the heat transfer system 10 also advantageously facilitates service, replacement and upgrade of the heat transfer system.

A method aspect of the present invention is for warming water for a water supply. The method includes propelling a refrigerant through a refrigerant line 24. The refrigerant passes through a refrigerant evaporator 26 to warm the refrigerant to a cooled gas, a vapor compressor 28 to heat the cooled gas to a super-heated gas, a condenser 30 to cool the super-heated gas to a warmed liquid, and an expansion device 32 to cool the warmed liquid to a bi-phase liquid, and back to the refrigerant evaporator.

The method also includes pumping water using a variable speed water pump 36 through a water line 18 adjacent the refrigerant line 24 to absorb heat from the refrigerant. The water passes through the condenser 30 to be warmed to a predetermined water temperature, and exits the condenser to be stored in the water storage member 20.

The method also includes remotely operating a controller 52 to control capacity of the vapor compressor 26 responsive to demand by varying the speed of the vapor compressor. The water line and the refrigerant line are isolated from one another in double walled plate heat exchangers.

Another method aspect of the present invention is for doing business. More specifically, the heat transfer system 10 of the present invention is preferably installed at a large structure 12, such as a hotel. Use of the heat transfer system 10 of the present invention advantageously enhances monetary savings by decreasing the costs of operating a traditional system to heat water. For example, the heat transfer system 10 of the present invention advantageously decreases fuel costs associated with typical fuel burning warmers. Accordingly, a certain cost savings is attributed to the heat transfer system 10.

Therefore, the heat transfer system may advantageously be installed at the structure 12 and leased to the owner of the structure. The lease payments may, for example, be directly attributed to fuel cost savings associated with decreased energy costs. Those skilled in the art will appreciate that any type of formula may be used to determine lease payments that are directly related to energy cost savings. Those skilled in the art will also appreciate that the present invention contemplates sale or lease of the heat transfer system 10 to the owner of the structure 12. In such an example, the sale price of the heat transfer system 10 may be related to estimated energy cost savings.

Another method aspect of the present invention is also for doing business. More particularly, there exists a certain number of carbon emissions associated with burning fuel to produce energy. The avoidance of carbon emissions are defined as carbon credits. More particularly, carbon credits are related to tons of carbon dioxide avoided from atmospheric discharge. For instance, the structure 12 may have an existing furnace to heat water with a known fuel. The furnace efficiency and carbon dioxide emission are based on usage. The heat transfer system 10 can be retrofitted making the existing heating system redundant. Accordingly, the fuel valves may be turned off and carbon dioxide emissions may be eliminated.

The heat transfer system 10 of the present invention advantageously enhances fuel savings for the structure 12. Accordingly, the owner of the heat transfer system 10 may generate carbon credits. In other words, a structure 12 using the heat transfer system 10 of the present invention does not require as much fuel to produce energy to heat water as may be required by a structure that does not have the heat transfer system of the present invention installed therein. Therefore, emissions of carbon dioxide at such a structure are greatly decreased.

The owner of the heat transfer system 10 may also have excess carbon credits. These carbon credits may be traded as a commodity. In other words, the excess carbon credits may be sold. Therefore, the owner of the heat transfer system 10 advantageously benefits from fuel savings associated with the heat transfer system, i.e., decreased costs of heating potable water and decreased costs of cooling air in air conditioning system, and also monetarily benefits from the sale of carbon credits. The carbon credits may also be accumulated by the owner for use to fund future development.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A heat transfer system comprising:

a water line for carrying water having a first predetermined flow direction, said water line being in fluid communication with at least one water supply;

a refrigerant line for carrying a refrigerant, said refrigerant line having a second predetermined flow direction opposite the first predetermined flow direction;

a refrigerant evaporator in fluid communication with said refrigerant line;

a vapor compressor in fluid communication with said refrigerant line;

a refrigerant de-superheater in fluid communication with said refrigerant line and said water line;

a refrigerant condenser in fluid communication with said water line and said refrigerant line;

a refrigerant sub-cooler in fluid communication with said water line and said refrigerant line;

an expansion device in fluid communication with said refrigerant line;

wherein the refrigerant enters said refrigerant evaporator as a liquid and is warmed within said refrigerant evaporator to a cooled gas, and wherein the refrigerant enters said vapor compressor as a cool gas and is heated to a superheated gas, and wherein the refrigerant enters said refrigerant de-superheater as a superheated gas and is cooled to a hot gas, and wherein the refrigerant enters said refrigerant condenser as a hot gas and is cooled to a warmed liquid, and wherein the refrigerant enters said refrigerant sub-cooler as a warmed liquid and is cooled to a cooled liquid, and wherein the refrigerant enters said expansion device as a cooled liquid and is cooled to a bi-phase liquid, and wherein the refrigerant exits said expansion device and is passed to said refrigerant evaporator; and wherein the water enters said refrigerant sub-cooler and is warmed to a first predetermined water temperature, and wherein the water enters said refrigerant condenser at a second predetermined water temperature and is warmed to a third predetermined water temperature, and wherein the water enters said refrigerant de-superheater at the third predetermined water temperature and is warmed to a fourth predetermined water temperature, and wherein the water exits said refrigerant de-superheater and is passed to the at least one water supply at the fourth predetermined water temperature.

2. A heat transfer system according to claim 1 wherein each of said refrigerant evaporator, vapor compressor, refrigerant de-superheater, refrigerant condenser, refrigerant sub-cooler and expansion device each comprises a refrigerant inlet and a refrigerant outlet.

3. A heat transfer system according to claim 1 wherein each of said refrigerant sub-cooler, refrigerant condenser and refrigerant de-superheater comprises a refrigerant inlet, a refrigerant outlet, a water inlet and a water outlet.

4. A heat transfer system according to claim 3 wherein the at least one water supply comprises a first and a second water supply; wherein the first water supply is at least one water storage member; and wherein the second water supply is a municipal water supply.

5. A heat transfer system according to claim 4 wherein the water from the at least one water storage member is mixed with water from the municipal water supply after the water from the municipal water supply is passed through said refrigerant sub-cooler; and wherein the water from the at least one water storage member is taken from the at least one water storage member adjacent a bottom thereof.

6. A heat transfer system according to claim 4 further comprising a water pump in communication with said water line to pump water from the at least one water storage member and from the water outlet of said refrigerant sub-cooler through said water line.

7. A heat transfer system according to claim 6 further comprising a controller in communication with said vapor compressor to control capacity of said vapor compressor responsive to demand; and wherein said controller is remotely operable over a global communications network.

8. A heat transfer system according to claim 7 further comprising at least one temperature sensor adjacent an outlet of said water pump and in communication with said controller; and wherein said controller is responsive to said at least one temperature sensor to vary capacity of said vapor compressor.

9. A heat transfer system according to claim 8 further comprising a second water line in communication with said refrigerant evaporator and an air conditioning return water line, said second water line passing warmed water from the air conditioning return water line through said refrigerant evaporator to warm the refrigerant in said refrigerant evaporator, and back to the air conditioning return water line.

10. A heat transfer system according to claim 1 further comprising a housing to carry each of said refrigerant evaporator, vapor compressor, refrigerant de-superheater, refrigerant condenser, refrigerant sub-cooler and expansion device.

11. A heat transfer system according to claim 1 wherein the refrigerant enters said refrigerant evaporator at a temperature between about 35 degrees Fahrenheit and 55 degrees Fahrenheit; wherein the refrigerant exits said refrigerant evaporator at a temperature between about 35 degrees Fahrenheit and 55 degrees Fahrenheit; wherein the refrigerant exits said vapor compressor at a temperature between about 150 degrees Fahrenheit and 185 degrees Fahrenheit; wherein the refrigerant exits said refrigerant de-superheater at a temperature between about 130 degrees Fahrenheit and 145 degrees Fahrenheit; wherein the refrigerant exits said refrigerant condenser at a temperature between about 115 degrees Fahrenheit and 125 degrees Fahrenheit; wherein the refrigerant exits said refrigerant sub-cooler at a temperature between about 85 degrees Fahrenheit and 95 degrees Fahrenheit; and wherein the refrigerant exits said expansion device at a temperature between about 35 degrees Fahrenheit and 55 degrees Fahrenheit.

12. A heat transfer system according to claim 7 wherein the water enters said refrigerant sub-cooler from the municipal water supply at a temperature between about 65 degrees Fahrenheit and 85 degrees Fahrenheit; wherein the water exits said refrigerant sub-cooler at the first predetermined water temperature between about 95 degrees Fahrenheit and 110 degrees Fahrenheit; wherein water is taken from the bottom of the at least one water storage member at a temperature of between about 125 degrees Fahrenheit and 135 degrees Fahrenheit; and wherein the water exiting said refrigerant sub-cooler is mixed with the water exiting the at least one water storage member to define mixed water.

13. A heat transfer system according to claim 11 wherein the second predetermined water temperature is defined by the temperature of the mixed water being between about 115 degrees Fahrenheit and 125 degrees Fahrenheit; wherein the water enters said refrigerant condenser at the second predetermined water temperature and is warmed to the third predetermined water temperature between about 130 degrees Fahrenheit and 135 degrees Fahrenheit; and wherein the water enters said refrigerant de-superheater at the third predetermined water temperature and exits said refrigerant de-superheater at the fourth predetermined water temperature between about 135 degrees Fahrenheit and 140 degrees Fahrenheit.

14. A heat transfer system according to claim 1 wherein said refrigerant sub-cooler, refrigerant condenser and refrigerant de-superheater are double walled heat exchangers to isolate the water from the refrigerant.

15. A heat transfer system according to claim 1 wherein said water line carries potable water.

16. A heat transfer system according to claim 1 wherein the refrigerant is a naturally occurring refrigerant.

17. A heat transfer system according to claim 9, further comprising at least one power source connector carried by said housing to be connected to a power source.

18. A heat transfer system comprising:

a water line for carrying water having a first predetermined flow direction, said water line being in fluid communication with at least one water supply;

a refrigerant line for carrying a refrigerant, said refrigerant line having a second predetermined flow direction opposite the first predetermined flow direction;

a refrigerant evaporator in fluid communication with said refrigerant line;

a vapor compressor in fluid communication with said refrigerant line;

a condenser in fluid communication with said refrigerant line and said water line;

an expansion device in fluid communication with said refrigerant line;

a variable speed water pump in communication with said water line to pump water from the at least one water supply through said water line;

a controller in communication with said vapor compressor to control capacity of said vapor compressor responsive to demand, said controller being remotely operable over a global communications network to control water flow through said water line responsive to water demand; and at least one temperature sensor adjacent an outlet of said variable speed water pump and in communication with said controller, said controller being responsive to said at least one temperature sensor to vary capacity of said vapor compressor;

wherein the refrigerant enters said refrigerant evaporator as a liquid and is warmed to cooled gas, wherein the refrigerant enters said vapor compressor as a cool gas and is heated to a superheated gas, wherein the refrigerant enters said condenser as a superheated gas and is cooled to a cooled liquid, wherein the refrigerant enters said expansion device as a cooled liquid and is cooled to a bi-phase liquid, and wherein the refrigerant exits said expansion device and is passed to said refrigerant evaporator;

wherein the water enters said condenser, wherein heat is exchanged between the refrigerant and the water to warm the water to a predetermined water temperature, and wherein the water exits said condenser and is passed to the at least one water storage member at the predetermined temperature; and wherein said condenser is a double walled heat exchanger comprising at least one refrigerant line having an exterior wall and at least one water line adjacent to and apart from said at least one refrigerant line, said at least one water line having an exterior wall, wherein said refrigerant line exterior wall and said water line exterior wall are not shared so as to isolate the water from the refrigerant;

and wherein said condenser further comprises a refrigerant de-superheater in fluid communication with said refrigerant line and said water line, a refrigerant condenser in fluid communication with said water line and said refrigerant line, and a refrigerant sub-cooler in fluid communication with said water line and said refrigerant line.

19. A heat transfer system according to claim 18 wherein the refrigerant enters said refrigerant de-superheater as a superheated gas and is cooled to a hot gas, wherein the refrigerant enters said refrigerant condenser as a hot gas and is cooled to a warmed liquid, wherein the refrigerant enters said refrigerant sub-cooler as a warmed liquid and is a cooled to a cooled liquid.

20. A heat transfer system according to claim 19 wherein each of said refrigerant evaporator, vapor compressor, refrigerant de-superheater, refrigerant condenser, refrigerant sub-cooler, and expansion device comprises a refrigerant inlet and a refrigerant outlet; and wherein each of said refrigerant sub-cooler, refrigerant condenser and refrigerant de-superheater comprises a water inlet and a water outlet.

21. A heat transfer system according to claim 20 further comprising a second water line in communication with said refrigerant evaporator and an air conditioning return water line, said second water line passing warmed water from the air conditioning return water line through said refrigerant evaporator to warm the refrigerant in said refrigerant evaporator, and back to the air conditioning return water line.

22. A heat transfer system according to claim 21 wherein the at least one water supply comprises a first and a second water supply; wherein the first water supply is at lease one water storage member; and wherein the second water supply is a municipal water supply.

23. A heat transfer system according to claim 22 wherein water from the at least one water storage member is mixed with water from the municipal water supply after the water from the municipal water supply is passed through said refrigerant sub-cooler; and wherein the water from the at least one water storage member is taken from the at least one water storage member adjacent a bottom thereof.

24. A heat transfer system according to claim 18 further comprising a housing to carry each of said refrigerant evaporator, vapor compressor, condenser and expansion device.

25. A heat transfer system according to claim 23 wherein the refrigerant enters said refrigerant evaporator at a temperature between about 35 degrees Fahrenheit and 55 degrees Fahrenheit; wherein the refrigerant exits said refrigerant evaporator at a temperature between about 35 degrees Fahrenheit and 55 degrees Fahrenheit; wherein the refrigerant exits said vapor compressor at a temperature between about 150 degrees Fahrenheit and 185 degrees Fahrenheit wherein the refrigerant exits said refrigerant de-superheater at a temperature between about 130 degrees Fahrenheit and 145 degrees Fahrenheit; wherein the refrigerant exits said refrigerant condenser at a temperature between about 115 degrees Fahrenheit and 125 degrees Fahrenheit; wherein the refrigerant exits said refrigerant sub-cooler at a temperature between about 85 degrees Fahrenheit and 95 degrees Fahrenheit; and wherein the refrigerant exits said expansion device at a temperature between about 35 degrees Fahrenheit and 55 degrees Fahrenheit.

26. A heat transfer system according to claim 23 wherein the water enters said refrigerant sub-cooler from the municipal water supply at a temperature between about 65 degrees Fahrenheit and 85 degrees Fahrenheit; wherein the water exits said refrigerant sub-cooler at the first predetermined water temperature between about 95 degrees Fahrenheit and 110 degrees Fahrenheit; wherein water is taken from the bottom of the at least one water storage member at a temperature of between about 125 degrees Fahrenheit and 135 degrees Fahrenheit; and wherein the water exiting said refrigerant sub-cooler is mixed with the water exiting the at least one water storage member to define mixed water.

27. A heat transfer system according to claim 26 wherein the mixed water has a second predetermined water temperature between about 115 degrees Fahrenheit and 125 degrees Fahrenheit; wherein the water enters said refrigerant condenser at the second predetermined water temperature and is warmed to a third predetermined water temperature between about 130 degrees Fahrenheit and 135 degrees Fahrenheit; and wherein the water enters said refrigerant de-superheater at the third predetermined water temperature and exits said refrigerant de-superheater at a fourth predetermined temperature between about 135 degrees Fahrenheit and 140 degrees Fahrenheit.

28. A heat transfer system according to claim 18 wherein said water line carries potable water.

29. A heat transfer system according to claim 18 wherein the refrigerant is a naturally occurring refrigerant.

30. A heat transfer system according to claim 24, further comprising at least one power source connector carried by said housing to be connected to a power source.

* * * * *